US006857364B2

(12) United States Patent
Görbing et al.

(10) Patent No.: US 6,857,364 B2
(45) Date of Patent: Feb. 22, 2005

(54) CLUTCH FOR DRIVE ELEMENTS OF A PRINTING MACHINE

(75) Inventors: Christian Görbing, Heidelberg (DE); Karl-Heinz Helmstädter, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 89 days.

(21) Appl. No.: 10/113,416

(22) Filed: Apr. 1, 2002

(65) Prior Publication Data

US 2002/0139263 A1 Oct. 3, 2002

(30) Foreign Application Priority Data

Mar. 30, 2001 (DE) ..... 101 15 874

(51) Int. Cl.[7] ..... B41F 5/02

(52) U.S. Cl. ..... 101/230; 101/246; 101/248; 101/183; 192/21.5; 192/86

(58) Field of Search ..... 101/230, 246, 101/248; 192/21.5, 86, 56.3; 74/395, 400, 401, 439, 440, 444

(56) References Cited

U.S. PATENT DOCUMENTS

| | | | | |
|---|---|---|---|---|
| 2,081,644 A | | 5/1937 | Smythe | |
| 2,575,360 A | * | 11/1951 | Rainbow | 192/21.5 |
| 2,658,596 A | * | 11/1953 | Archambault | 192/86 |
| 3,420,344 A | | 1/1969 | Hilpert et al. | |
| 4,072,064 A | * | 2/1978 | Lloyd et al. | 74/409 |
| 4,478,320 A | | 10/1984 | Baba | |
| 4,716,827 A | | 1/1988 | Wieland et al. | |
| 5,094,328 A | * | 3/1992 | Palmer | 192/21.5 |
| 5,365,845 A | * | 11/1994 | Becker | 101/230 |
| 5,802,920 A | * | 9/1998 | Becker | 74/439 |
| 5,823,309 A | * | 10/1998 | Gopalswamy et al. | 192/21.5 |
| 5,896,695 A | * | 4/1999 | Walker | 43/107 |
| 5,988,336 A | * | 11/1999 | Wendt et al. | 192/21.5 |
| 6,102,827 A | * | 8/2000 | Teasdale et al. | 475/154 |

FOREIGN PATENT DOCUMENTS

| | | |
|---|---|---|
| DE | 27 00 174 | 12/1977 |
| DE | 32 37 189 C2 | 4/1983 |
| DE | 35 34 486 A1 | 4/1987 |
| DE | 42 14 228 A1 | 11/1993 |
| DE | 43 26 155 A1 | 2/1994 |
| DE | 197 35 897 A1 | 2/1999 |
| DE | 198 58 417 A1 | 6/2000 |
| DE | 198 47 405 C1 | 7/2000 |
| WO | WO 01/01021 A1 | 1/2001 |

* cited by examiner

*Primary Examiner*—Andrew H. Hirshfeld
*Assistant Examiner*—Andrea H. Evans
(74) *Attorney, Agent, or Firm*—Laurence A. Greenber; Werner H. Stemer; Ralph E. Locher

(57) ABSTRACT

A device for locking, with respect to a first power transmission element, a further power transmission element that is lockable in a rotational position thereof, provides for the first and the further power transmission element to have a common working chamber with a variable volume to which a pressure medium can be applied, it being possible for the pressure medium in the working chamber to be solidified by applying an electric voltage or a magnetic force field thereto.

20 Claims, 4 Drawing Sheets

CLUTCH FOR DRIVE ELEMENTS OF A PRINTING MACHINE

BACKGROUND OF THE INVENTION

Field of the Invention

The invention relates to a device for locking an adjustable gear having a phase that is adjustable with respect to a main gear.

Sheet-fed printing machines having a reversing device so as to be able to operate both in recto printing mode and in recto/verso or first-form and perfecting mode, require a device for adjusting the grippers taking part in the sheet transport, and for adjusting the phase position of the sheet-guiding cylinder. In this regard, it is customary for a cylinder involved in the sheet reversal to have a switchable or convertible double gear, via which a gear train arranged upstream of the reversing device is couplable to a gear train arranged downstream of the reversing device.

The prior art according to the published German Patent Document DE-C 35 34 486 C2 discloses arranging an adjustable gear so that it is rotatable on the hub of a main gear. The adjustable gear is adjusted with respect to the main gear by the drive of the gear train arranged upstream or downstream.

The adjustable gear is fixed onto the hub of the main gear by a "shrink fit". This "shrink fit" is loosened or released by hydraulic oil, which is pumped between the fitting or register surfaces of the adjustable gear and the main gear.

SUMMARY OF THE INVENTION

Is accordingly an object of the invention to provide an alternative device for adjusting and/or fixing the phase position of a first power transmission element with respect to a second power transmission element.

With the foregoing and other objects in view, there is provided, in accordance with one aspect of the invention, a device for locking, with respect to a first power transmission element, a further power transmission element that is adjustable in rotational position thereof, comprising a working chamber common to the first power transmission element and the further power transmission element, the common working chamber being adjustably variable, and being fillable with a pressure medium formed of a rheological liquid.

In accordance with another aspect of the invention, there is provided a device for locking, with respect to a first power transmission element, a further power transmission element that is adjustable in rotational position thereof, comprising a working chamber common to the first power transmission element and the further power transmission element, and a rheological liquid received in said common working chamber and, upon an application of pressure, serving to effect an adjustment of the rotational position of the two power transmission elements with respect to one another.

In accordance with a further feature of the invention, the first power transmission element is a main gear, and the further power transmission element is an adjustable gear.

In accordance with an added feature of the invention, the adjustable gear is formed with a groove, and the main gear is formed with a piston engaging in the groove.

In accordance with an additional feature of the invention, the locking device further comprises an operating cylinder for rotating the adjustable gear and the main gear with respect to one another.

In accordance with yet another feature of the invention, the locking device further comprises a connecting line connected to the respective ends of the groove so as to form a closed circuit.

In accordance with yet a further feature of the invention, the groove has one of an electric voltage and a magnetic force field applicable thereto.

In accordance with yet an added feature of the invention, the operating cylinder has one of an electric voltage and a magnetic force field applicable thereto.

In accordance with still another feature of the invention, the locking device further comprises feed lines for feeding the rheological liquid into the common working chamber, the feed lines having one of an electric voltage and a magnetic force field applicable thereto.

In accordance with still a further feature of the invention, the connecting line has one of an electric voltage and a magnetic force field applicable thereto.

In accordance with another aspect of the invention, there is provided a reversing device of a printing machine having incorporated therein a device for locking, with respect to a first power transmission element, a further power transmission element that is adjustable in rotational position thereof, comprising a working chamber common to the first power transmission element and the further power transmission element, the common working chamber being adjustably variable, and being fillable with a pressure medium formed of a rheological liquid.

In accordance with a concomitant aspect of the invention, there is provided a reversing device of a printing machine having incorporated therein a device for locking, with respect to a first power transmission element, a further power transmission element that is adjustable in rotational position thereof, comprising a working chamber common to the first power transmission element and the further power transmission element, and a rheological liquid received in the common working chamber and, upon an application of pressure, serving to effect an adjustment of the rotational position of the two power transmission elements with respect to one another.

It is a particular advantage of the invention that very high torques can be transmitted with the locking according to the invention, which is free of play. As a result of this measure, the invention can even be used on reversing or turning devices of printing machines having a large number of printing units.

A further advantage is the continuous adjustability and high torsional rigidity of the torque-transmitting parts.

In addition, it is advantageous that the device can also be used to introduce the adjusting movement during conversion or change-over of the reversing device.

In a preferred embodiment, the main gear and the adjustable gear, by suitable shaping or machining, form a working chamber which can be varied by being adjusted and which can be filled with a pressure medium under pressure, so that a change occurs in the phase position between the main gear and the adjustable gear. As a result of these measures, an adjustment can even be made by an additional pressure generator, independently of the drive of the machine.

In a further exemplary embodiment, provision is made for arranging articulatedly an operating or working cylinder between the main gear and the adjustable gear, so that when an operating medium is applied to the operating cylinder, the latter effects rotation of the adjustable gear with respect to the main gear.

For the purpose of locking, the working medium, which is preferably a rheological liquid, is solidified as a result of the application of a voltage or the application of a magnetic force field, so that an exact unchangeable fit or seating of the adjustable gear with respect to the main gear is produced.

Other features which are considered as characteristic for the invention are set forth in the appended claims.

Although the invention is illustrated and described herein as embodied in a clutch for drive elements of a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
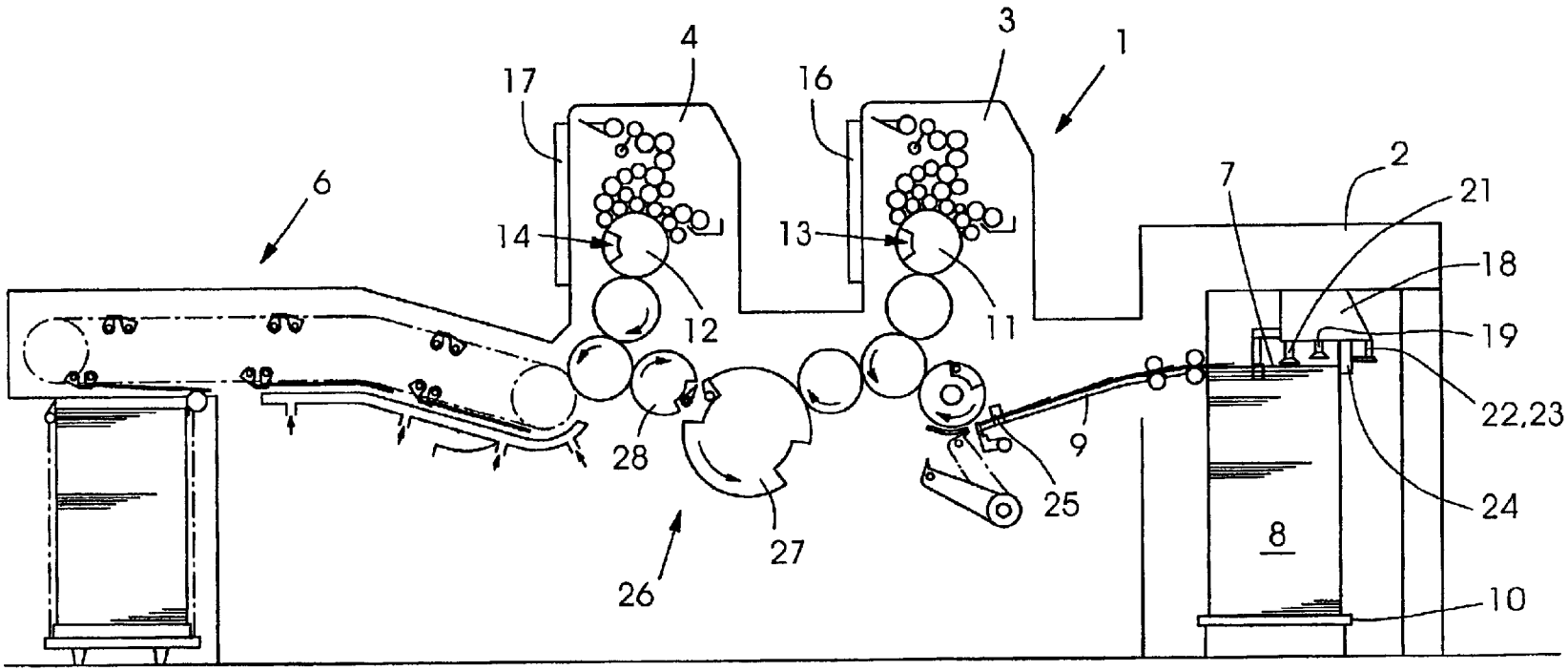
FIG. 1 is a diagrammatic side elevational view of a sheet-fed rotary printing machine.
Figure 2:
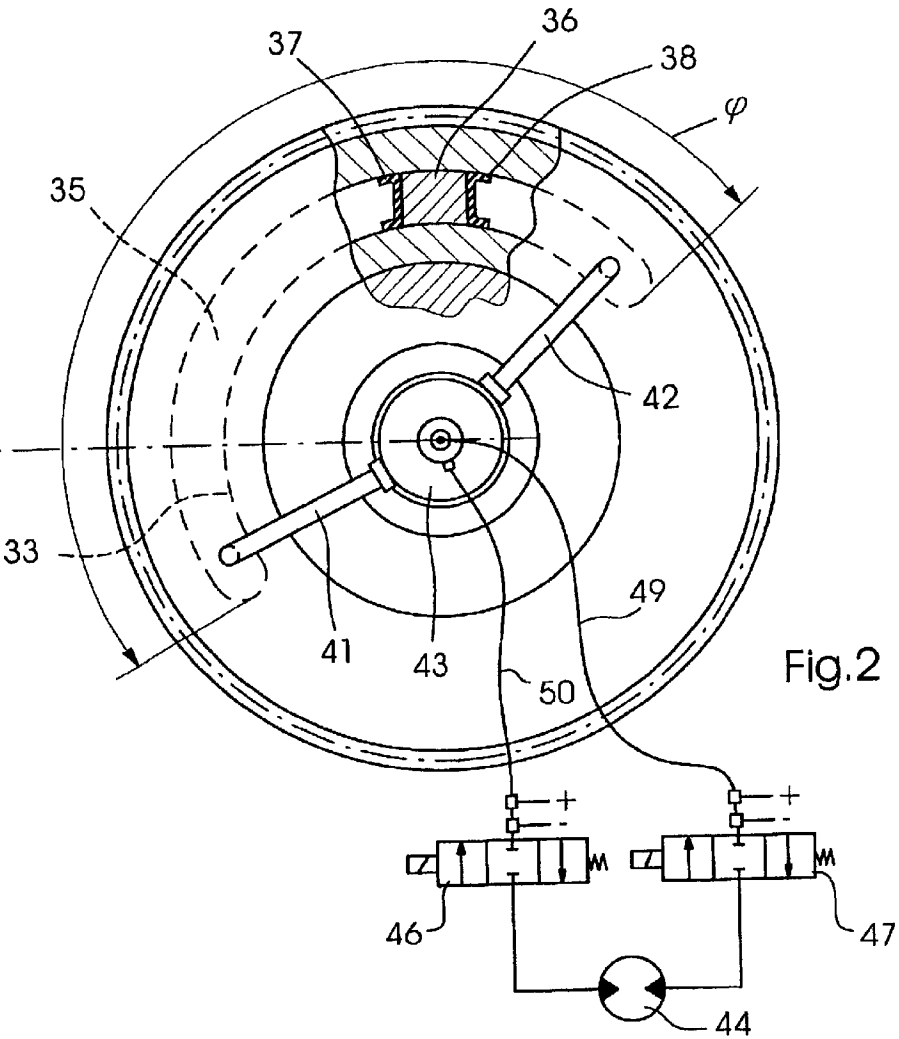
FIG. 2 is a diagrammatic and schematic plan view of the main gear of the printing machine, shown partly broken away and in section.

Referring now to the drawings and, first, particularly to FIG. 1, there is shown therein a rotary printing machine, for example, a printing machine 1 for processing sheets 7, having a feeder 2, at least one printing unit 3 and 4 and a delivery 6. The sheets 7 are taken from a sheet pile 8 and, singly or overlappingly, are fed over a feeding table 9 to the printing units 3 and 4, which, respectively, include a plate cylinder 11, 12 provided in a conventional manner. The plate cylinders 11 and 12, respectively, have a device 13, 14 for fastening flexible printing plates thereon. Furthermore, each plate cylinder 11, 12 has assigned thereto a device 16, 17 for semi-automatically or fully automatically changing printing plates.

The sheet pile 8 rests on a controllably liftable pile or stacking board 10. Removal of the sheets 7 is carried out from the top of the sheet pile 8 by a so-called suction head 18, which amongst other things has a number of lifting and dragging suckers 19 and 21 for separating or singling the sheets 7. In addition, blast or blowing devices 22 are provided for loosening the upper sheet layers, and sensing elements 23 are provided for pile tracking. In order to align the sheet pile 8, in particular the upper sheets 7 of the sheet pile 8, a number of lateral and rear stops 24 are provided.

In order to reverse or turn a sheet between the provided printing units 3 and 4, which are illustrated here only by way of example, for a larger number of printing units, a sheet reversing device 26 having a storage drum 27 and a reversing or turning drum 28 is provided.

Figure 3:
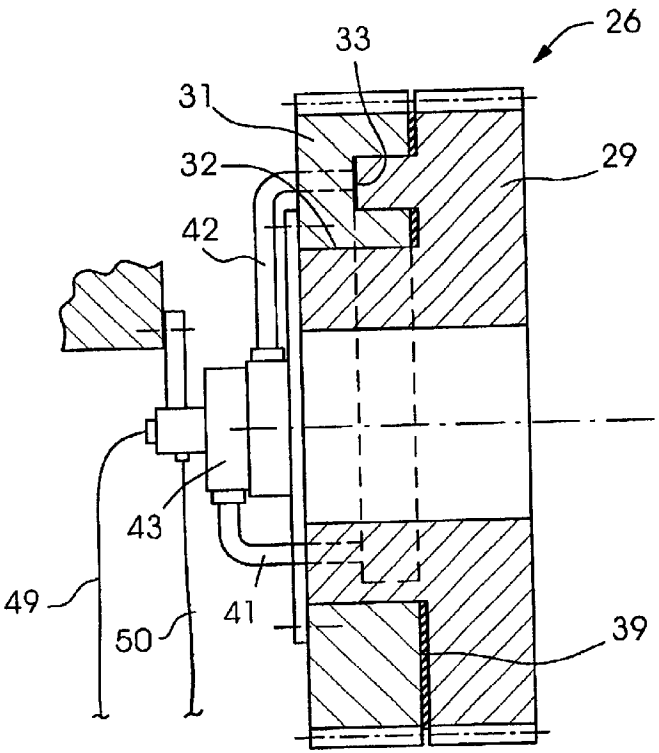
FIG. 3 is a diagrammatic and schematic cross-sectional view of a double gear according to the invention.

One of the drums 27 or 28 involved in the reversal has a double gear 29, 31, as shown in FIG. 3, for the necessary adjustment of the phase position between the transport grippers and the reversing or turning grippers, the double gear comprising a main gear 29 and an adjustable gear 31 which is arranged parallel thereto and is preferably mounted on a hub 32 of the main gear 29 so that the phase of the adjustable gear 31 can be adjusted. In this regard, the main gear 29 has a drive connection with one of the gear trains arranged upstream or downstream from the reversing or turning device 26, and the adjustable gear 31 has a drive connection with the respective other gear train. In a desired phase position, the adjustable gear 31 can be coupled to the main gear 29.

The adjustable gear 31 is formed with an arc-like groove 33, which has a length corresponding at least approximately with a maximum adjustment angle 9. A projection 36 on the main gear 29, which is formed as an operating piston 36, projects into the groove 33. The operating piston 36 has two sealing lips 37 and 38. An end seal 39 is arranged between the adjustable gear 31 and the main gear 29. By two supply lines 41 and 42 connected, respectively, to the ends of the groove 33, the latter can be acted upon by a pressure medium, for example, hydraulic oil, preferably a rheological liquid.

Supply lines 49 and 50 connect a rotary inlet 43 to a stationary pressure-medium generator 44. Between the rotary inlet 43 and the pressure-medium generator 44, two directional control valves 46 and 47 are connected into the supply lines 49 and 50. By switching the valves 46 and 47, the groove 33 formed as an operating cylinder can have pressure applied thereto so that the piston 36 is moved in the groove 33, which results in setting the phase of the adjustable gear 31 and the main gear 29 and the gears, cylinders, grippers and so forth connected thereto. Thus, the application of pressure by the rheological liquid to the working chamber 35 formed, for example, by the groove 33, results in a rotative adjustment of the gears 29 and 31 in relation to one another.

In the desired phase position, the valves 46 and 47 are closed, and the feed lines 41 and 42 or the respective ends of the groove 33 have an electric voltage or a magnetic force field applied thereto. By this measure, the employed rheological fluid is solidified, so that a firm fit of the adjustable gear 31 with respect to the main gear 29 is achieved. Due to this measure, a rotational movement of the gears relative to one another is directly prevented by the rheological, solidified liquid.

Figure 4:
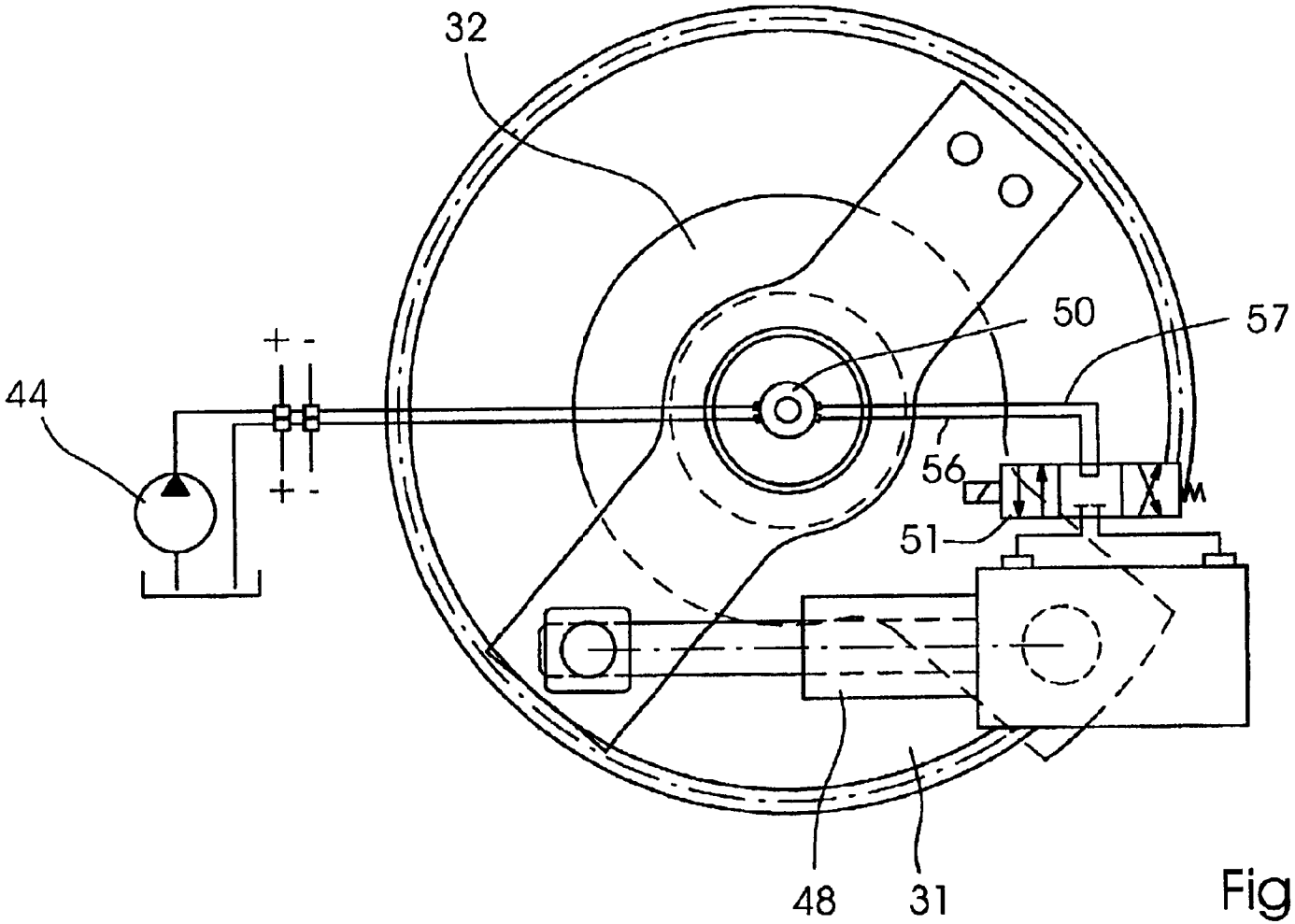
FIG. 4 is a plan view of the double gear of FIG. 3 provided with an alternative adjusting device.

In a second exemplary embodiment according to FIG. 4, provision is made for arranging an operating cylinder 48, comprising a cylinder and a piston, at the end of the adjustable gear 31 and the end of the hub 32 of the main gear 29 in such a manner (if appropriate, via a lever mechanism) that when pressure is applied to the operating cylinder 48, the adjustable gear 31 is rotated with respect to the main gear 29 over the desired phase angle $\phi$. The end of the setting movement can be initiated by closing a valve 51, which is arranged between a rotary leadthrough or bushing 50 and the operating cylinder 48. In the desired phase position of the main gear 29 and the adjustable gear 31, an electric voltage or a magnetic force field is applied to the operating cylinder 48 or the feed lines 56 and 57, in order to solidify the rheological liquid and to lock the gears 29 and 31.

Figure 5:
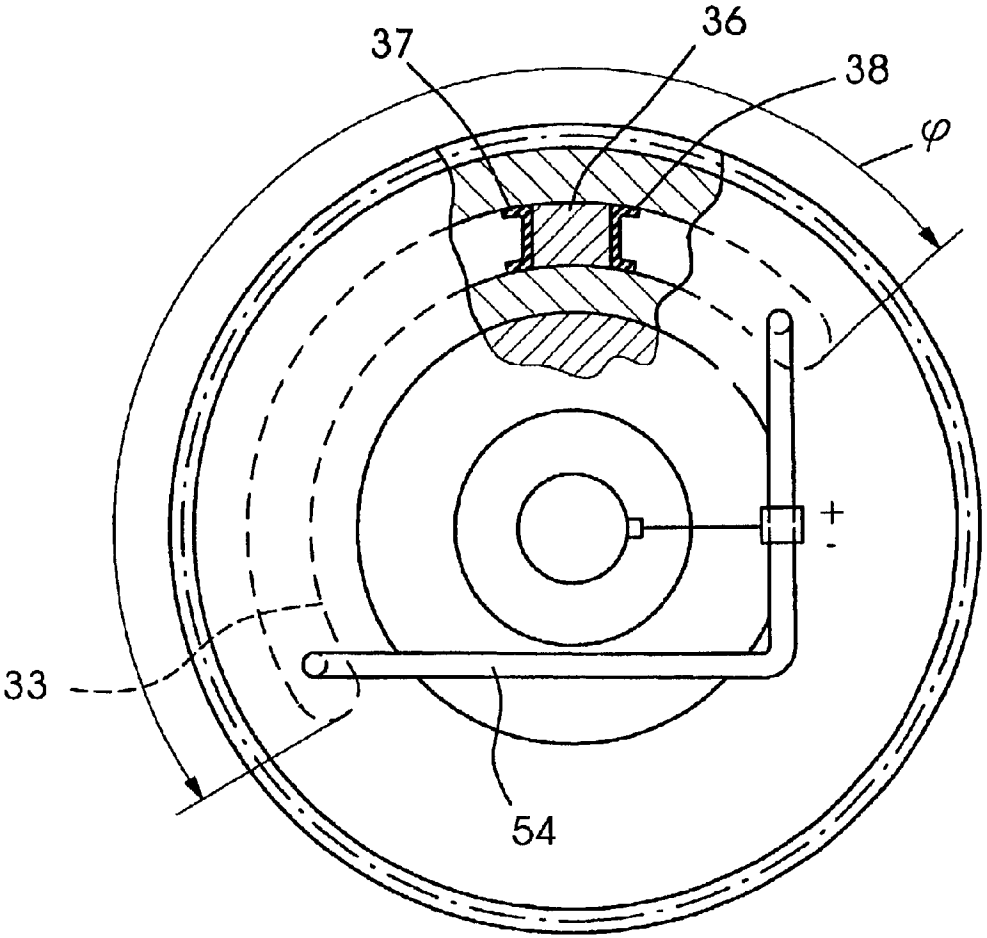
FIG. 5 is a view similar to that of FIG. 2 of a simplified exemplary embodiment.

In a third exemplary embodiment according to FIG. 5, the phase adjustment is effected by the main drive of the printing machine, so that it is possible to dispense with a rotary leadthrough or bushing and with valves, pressure generators and so forth.

The ends of the groove 33 are thereby coupled with one another by a connecting line 54. The groove 33 and the connecting line 54 are filled with a rheological liquid and therefore form a closed circuit. As in the case of the first exemplary embodiment, in the desired phase position of the adjustable gear 31 and the main gear 29, an electric voltage or a magnetic force field is applied to the groove 33 or the connecting line 54, in order to lock the adjustable gear 31 with respect to the main gear 29.

What is claimed is:

1. A device for locking, with respect to a first power transmission element, a further power transmission element adjustable in rotational position thereof, comprising:

a working chamber common to the first power transmission element and the further power transmission element, said common working chamber being subjected, between the elements to be coupled, to a change in volume upon a change of a rotational position of the elements to be coupled, and being fillable with a pressure medium formed of a rheological liquid.

2. A device for locking, with respect to a first power transmission element, a further power transmission element adjustable in rotational position thereof, comprising:

a working chamber common to the first power transmission element and the further power transmission element, said common working chamber being subjected, between the elements to be coupled, to a change in volume upon a change of a rotational position of the elements to be coupled; and a rheological liquid received in said common working chamber, said rheological liquid, upon an application of pressure, serving to effect an adjustment of the rotational position of the two power transmission elements with respect to one another.

3. The locking device according to claim 1, wherein the first power transmission element is a main gear, and the further power transmission element is an adjustable gear.

4. The locking device according to claim 2, wherein the first power transmission element is a main gear, and the further power transmission element is an adjustable gear.

5. The locking device according to claim 3, wherein said adjustable gear is formed with a groove, and said main gear is formed with a piston engaging in said groove.

6. The locking device according to claim 4, wherein said adjustable gear is formed with a groove, and said main gear is formed with a piston engaging in said groove.

7. The locking device according to claim 3, further comprising an operating cylinder for rotating said adjustable gear and said main gear with respect to one another.

8. The locking device according to claim 4, further comprising an operating cylinder for rotating said adjustable gear and said main gear with respect to one another.

9. The locking device according to claim 5, further comprising a connecting line connected to the respective ends of said groove so as to form a closed circuit.

10. The locking device according to claim 6, further comprising a connecting line connected to the respective ends of said groove so as to form a closed circuit.

11. The locking device according to claim 5, wherein said groove has one of an electric voltage and a magnetic force field applicable thereto.

12. The locking device according to claim 6, wherein said groove has one of an electric voltage and a magnetic force field applicable thereto.

13. The locking device according to claim 7, wherein said operating cylinder has one of an electric voltage and a magnetic force field applicable thereto.

14. The locking device according to claim 8, wherein said operating cylinder has one of an electric voltage and a magnetic force field applicable thereto.

15. The locking device according to claim 1, further comprising feed lines for feeding said rheological liquid into said common working chamber, said feed lines having one of an electric voltage and a magnetic force field applicable thereto.

16. The locking device according to claim 2, further comprising feed lines for feeding said rheological liquid into said common working chamber, said feed lines having one of an electric voltage and a magnetic force field applicable thereto.

17. The locking device according to claim 9, wherein said connecting line has one of an electric voltage and a magnetic force field applicable thereto.

18. The locking device according to claim 10, wherein said connecting line has one of an electric voltage and a magnetic force field applicable thereto.

19. A reversing device of a printing machine having incorporated therein a device for locking, with respect to a first power transmission element, a further power transmission element adjustable in rotational position thereof, comprising:

a working chamber common to the first power transmission element and the further power transmission element, said common working chamber being subjected, between the elements to be coupled, to a change in volume upon a change of a rotational position of the elements to be coupled, and being fillable with a pressure medium formed of a rheological liquid.

20. A reversing device of a printing machine having incorporated therein a device for locking, with respect to a first power transmission element, a further power transmission element adjustable in rotational position thereof, comprising:

a working chamber common to the first power transmission element and the further power transmission element, said common working chamber being subjected, between the elements to be coupled, to a change in volume upon a change of a rotational position of the elements to be coupled; and a rheological liquid received in said common working chamber, said rheological liquid, upon an application of pressure, serving to effect an adjustment of the rotational position of the two power transmission elements with respect to one another.

* * * * *